US006647959B2

(12) United States Patent
Noguchi

(10) Patent No.: US 6,647,959 B2
(45) Date of Patent: Nov. 18, 2003

(54) FAIL-SAFE DEVICE FOR ELECTRONIC THROTTLE CONTROL SYSTEM

(75) Inventor: Takuro Noguchi, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/298,937

(22) Filed: Nov. 19, 2002

(65) Prior Publication Data

US 2003/0183194 A1 Oct. 2, 2003

(30) Foreign Application Priority Data

Mar. 28, 2002 (JP) ..... 2002-091805

(51) Int. Cl.[7] ..... F02D 1/00

(52) U.S. Cl. ..... 123/396; 123/406.13; 123/479; 123/399

(58) Field of Search ..... 123/396, 399, 123/406.13, 479, 397

(56) References Cited

U.S. PATENT DOCUMENTS 4,424,785 A * 1/1984 Ishida et al. ..... 123/479
4,491,112 A * 1/1985 Kanegae et al. ..... 123/479
5,063,901 A * 11/1991 Kaneyasu et al. ..... 123/406.13
5,372,112 A * 12/1994 Ohtaka et al. ..... 123/406.13
5,960,771 A * 10/1999 Watanabe ..... 123/396
6,073,610 A * 6/2000 Matsumoto et al. ..... 123/396

FOREIGN PATENT DOCUMENTS

JP 10-299513 10/1998

* cited by examiner

*Primary Examiner*—Erick Solis
(74) *Attorney, Agent, or Firm*—Sughrue Mion, PLLC

(57) ABSTRACT

A fail-safe device includes an intake air amount sensor, a throttle position sensor for detecting a throttle opening degree of an electronic throttle controller, an accelerator position sensor for detecting an accelerator opening degree as an amount of pressing down on an accelerator, an intake air amount control unit for controlling the intake air amount to the engine, a target air-fuel ratio control unit for controlling a fuel injection amount to be supplied to the engine, a target ignition timing control unit for controlling ignition timing of air-fuel mixture inside a cylinder of the engine; and an electronic throttle control system abnormality warning unit for deciding, when a first requirement and a second requirement are satisfied based on the output of each sensor, that the electronic throttle controller is in failure, and for, prior to warning of the abnormality of the electronic throttle controller, controlling each of the control units.

8 Claims, 5 Drawing Sheets

FAIL-SAFE DEVICE FOR ELECTRONIC THROTTLE CONTROL SYSTEM

BACKGROUND OF THE INVENTION

1. Field of the Invention

The present invention relates to a fail-safe device for an electronic throttle control system applied to a vehicle provided with an electronic throttle controller for electrically driving a throttle valve.

2. Description of the Related Art

Conventionally, an electronic throttle controller for an automobile engine has been developed with which electric signals are communicated between an accelerator and a throttle valve. In such an electronic throttle controller, there is no mechanical connection between the accelerator and the throttle valve. A target throttle opening degree is set by a computer based on the amount of operation of the accelerator (accelerator opening degree) and various other parameters, and the throttle valve is controlled accordingly.

Therefore, when the accelerator is not operated, that is, during idle operation where the accelerator opening degree is equal to or less than a small predetermined value, the electronic throttle controller can control the idle speed while making fine adjustment of the throttle valve. Further, such an electronic throttle controller can set the target throttle opening degree so as to correct the accelerator opening degree (operation by the driver) according to the driving condition of the vehicle and the operating condition of the engine. Therefore, with control of the throttle based on the thus obtained target throttle opening degree, the electric throttle controller can materialize engine operation with a good feeling.

On the other hand, an electronically-controlled fuel injector is generally in practical use. Based on various sensors and parameters indicating the driving condition of the vehicle and the operating condition of the engine, such an electronically-controlled fuel injector can, through a computer, arbitrarily control a target air-fuel ratio and timing of ignition in a stroke for compressing and exploding an air-fuel mixture inside the cylinder (target ignition timing). These features can be utilized both for improvement in the fuel efficiency performance of the engine and for improvement in output performance.

A system where the electronic throttle controller described above is applied to the aforementioned electronically-controlled fuel injector has recently become practical. More specifically, since the electronic throttle controller can control the throttle valve opening degree independently of the accelerator opening degree, it can supply more air to a combustion chamber than an amount corresponding to the accelerator opening degree, and thus, when the engine load is increased, for example, a required amount of air can be supplied to the combustion chamber even if the accelerator opening degree is small.

When such an electronic throttle controller is adopted, it is necessary to prepare emergency protection on the control side as a countermeasure against abnormality in each of sensors being a constituent of the electronic throttle controller or the system. As one such counter measure, a configuration can be considered where a plurality of accelerator position sensors (APSs) and a plurality of throttle position sensors (TPSs) as sensors each being a constituent of the electronic throttle controller are provided.

More particularly, double sensors are provided such that, when one of the sensors is in failure, the other of the sensors is used to electronically control the throttle. By providing the electronic throttle controller with such a double control system, the electronic throttle controller can exert fail-safe function, and thus, the safety and the reliability of the electronic throttle controller can be enhanced.

When one sensor of the double sensor system of the electronic throttle controller is in failure, the abnormality is decided and determined, and, at the same time, with fail-safe control which is set in advance, the safety when the electronic throttle controller is in failure is secured, and a warning light provided in an instrument panel is turned on to inform the driver of the abnormality in the sensor or the like.

However, when an actuator for electrically driving the electronic throttle controller or throttle valve, or a sensor being a constituent of the system is in failure; or when momentary abnormality (temporary abnormality) arises in which the state returns to a normal state before the time when a computer decides that a sensor being a constituent of the electronic throttle controller or electronic throttle control system is in failure, the rotational speed of the engine may unexpectedly increase until the computer determines the abnormality, and, due to the unexpected event, the driver may make a mistake in driving.

Causes of abnormal modes of the sensors each being a constituent of the electronic throttle controller and the electronic throttle control system include abnormality in the actuator for driving the throttle valve to open and close, abnormality in the accelerator position sensor and the throttle position sensor themselves, abnormality in a harness connecting the sensors to the computer, abnormality in a connector, abnormality in a sensor power source system, and a poor contact of a harness of the sensor power source system.

For example, during idle operation where the accelerator is not operated, if the actuator for driving the throttle valve to open and close is in failure, and is momentarily operated to open the throttle valve before the time when the computer decides that abnormality is caused, the intake air amount of the engine may be increased to unexpectedly increase the rotational speed of the engine against the driver's will.

As described above, the target throttle opening degree is set according to the accelerator opening degree and the set various parameters. However, during idle operation where the accelerator is not operated or when the accelerator opening degree is small, if a sensor value is increased due to an abnormal mode described above for a time period until the computer decides that abnormality is caused, the target throttle opening degree may be calculated to the increase side accordingly, the throttle valve may be operated to the open side, the intake air amount of the engine maybe increased, and thus, the rotational speed of the engine may be unexpectedly increased against the driver's will.

In this way, when the actuator for electrically driving the electronic throttle controller or throttle valve, or a sensor being a constituent of the system is in failure, the rotational speed of the engine may be unexpectedly increased for a time period until the computer decides that abnormality is caused. Thus, provision of means for avoiding this situation is a problem to be solved.

It is to be noted that, in the related art, technology is disclosed with which the safety of a vehicle is secured after deciding that abnormality is caused in an actuator for electrically driving an electronic throttle controller or a throttle valve, or a sensor being a constituent of the system, but the technology does not solve the above-described problem.

SUMMARY OF THE INVENTION

The present invention has been made to solve the above-described problem, and an object of the invention is therefore to obtain a fail-safe device for an electronic throttle control system capable of preventing unexpected increase in the rotational speed of an engine even when, in a vehicle provided with an electronic throttle controller, an actuator for electrically driving the electronic throttle controller or a throttle valve, or a sensor being a constituent of the system is in failure.

A fail-safe device for an electronic throttle control system according to the present invention includes an intake air amount sensor for detecting an intake air amount to an engine, a throttle position sensor for detecting a throttle opening degree of an electronic throttle controller, the electronic throttle controller controlling a throttle valve based on an amount of pressing down on an accelerator, an accelerator position sensor for detecting an accelerator opening degree as an amount of pressing down on the accelerator, an intake air amount control means for controlling the intake air amount to the engine, a target air-fuel ratio control means for controlling a fuel injection amount to be supplied to the engine and a target ignition timing control means for controlling ignition timing of air-fuel mixture inside a cylinder of the engine.

Also, the device includes an electronic throttle control system abnormality warning means for deciding, when a first requirement and a second requirement are satisfied based on the output of the intake air amount sensor, the throttle position sensor, and the accelerator position sensor, that the electronic throttle controller is in failure, and prior to warning of the abnormality of the electronic throttle controller, controlling the intake air amount control means, the target air-fuel ratio control means, and the target ignition timing control means.

As a result, the device can prevent in advance the rotational speed of the engine from unexpectedly increasing and the safety of the vehicle can be enhanced.

DETAILED DESCRIPTION OF THE PREFERRED EMBODIMENTS

Embodiment 1

A fail-safe device for an electronic throttle control system according to Embodiment 1 of the present invention is now described with reference to the accompanying drawings.

First, an entire engine controller is described with reference to FIG. 1.

Figure 1:
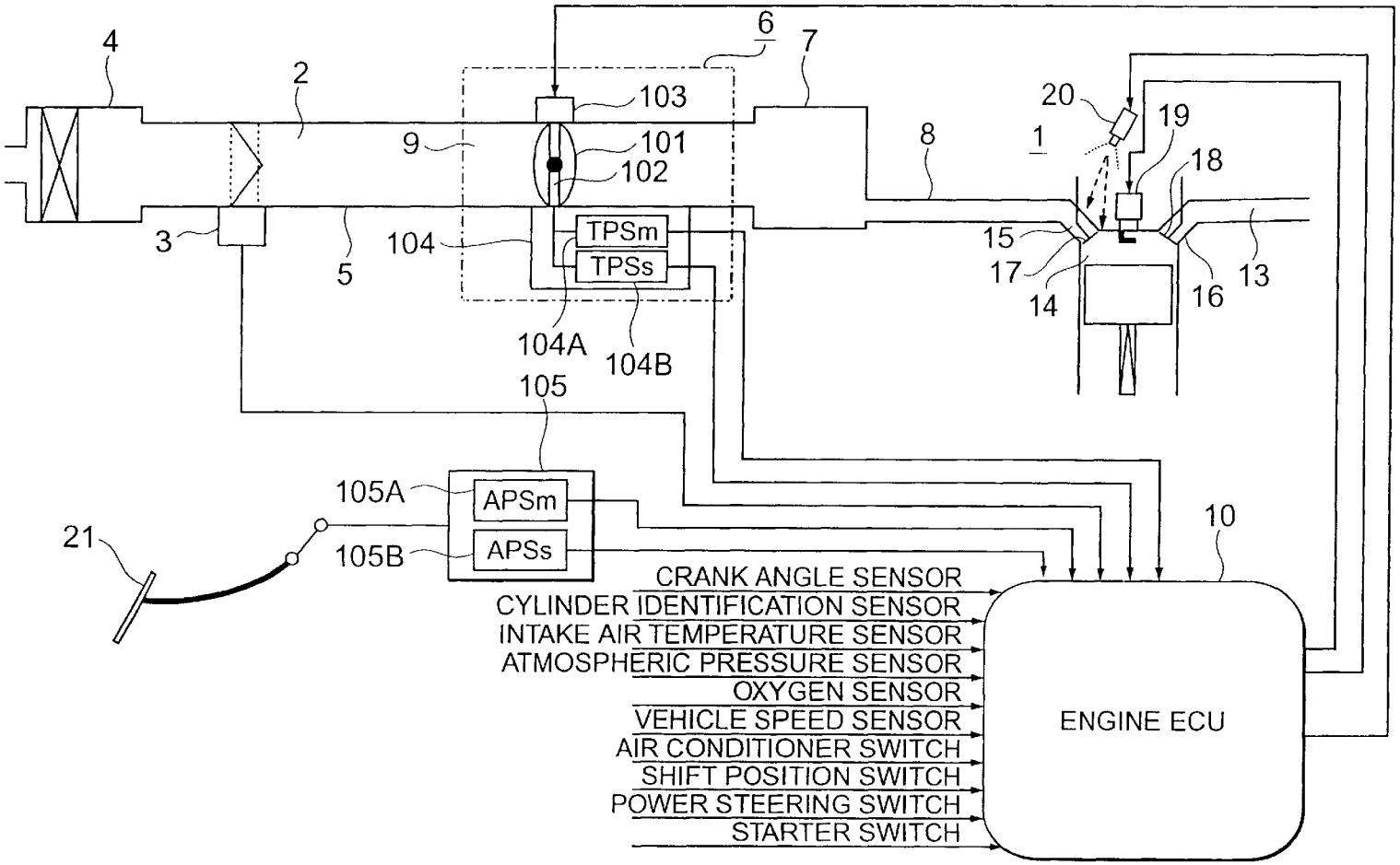
FIG. 1 is a view illustrating the entire configuration of an engine controller according to Embodiment 1 of the present invention.

FIG. 1 is a view illustrating the entire configuration of an engine controller. Like reference numerals designate like or corresponding parts throughout the figures.

In FIG. 1, reference numerals 1, 2, 3, and 4 denote an engine body, an intake air passage, an intake air amount sensor, and an air cleaner, respectively.

The intake air passage 2 is configured by an intake air tube 5, a throttle body 6, a surge tank 7, and an intake air manifold 8, which are connected in this order from the upstream side. The throttle body 6 is provided with an electronically-controlled throttle valve (intake air amount control means) 9 which is electrically controlled. The throttle opening degree of the electronically-controlled throttle valve 9 is detected by a throttle position sensor 104, and the opening degree of the electronically-controlled throttle valve 9 is controlled by an engine electronic computer unit (engine ECU) 10 which is described later. A target opening degree of the electronically-controlled throttle valve 9 (target throttle opening degree) is set according to the amount of pressing down on an accelerator pedal 21 (accelerator opening degree) detected by an accelerator position sensor 105 and to the operating condition of the engine.

Figure 2:
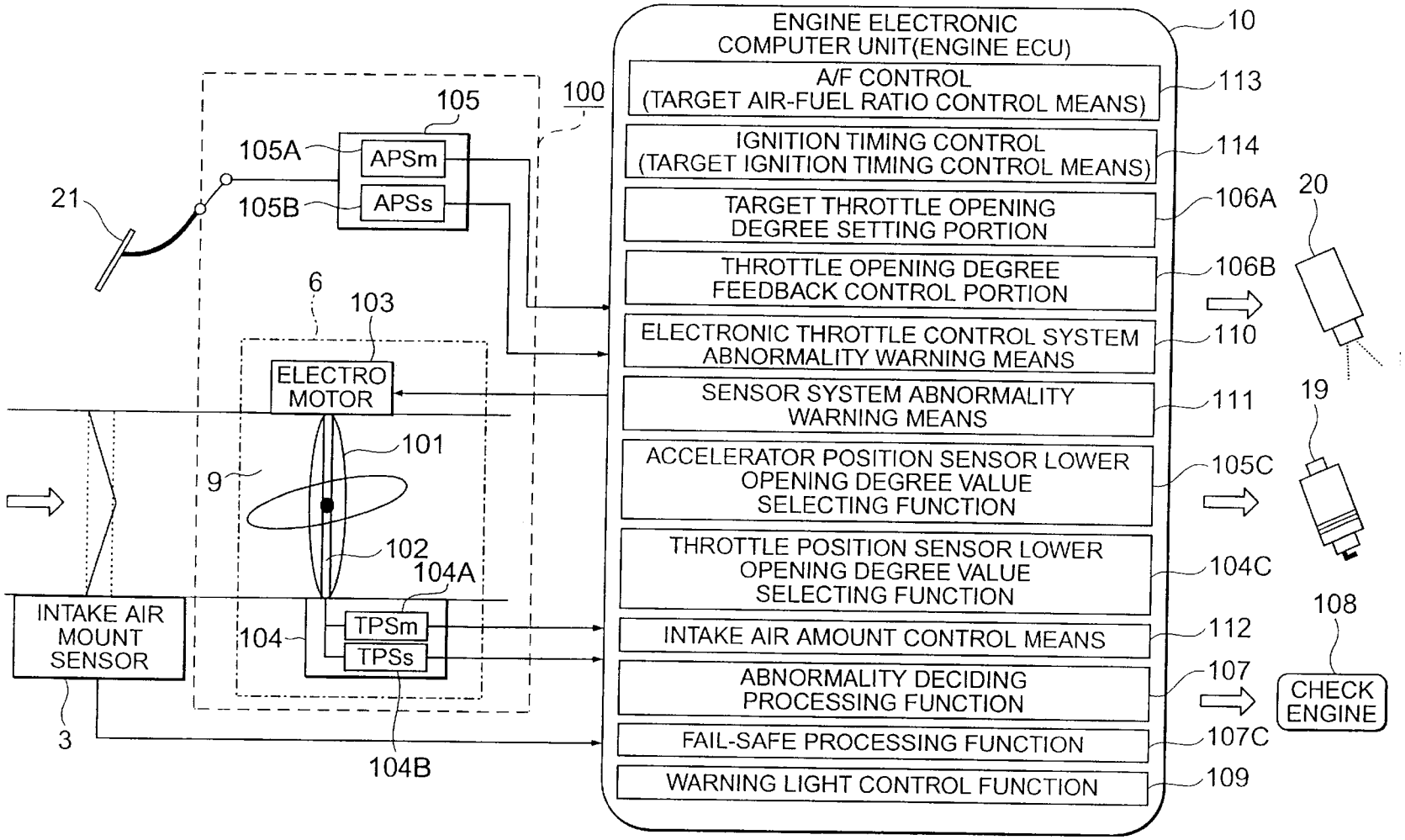
FIG. 2 is a view illustrating the configuration of an intake air control system of an electronic throttle controller according to Embodiment 1 of the present invention.

The electronically-controlled throttle valve 9, the throttle position sensor 104, the accelerator position sensor 105, and the like form an electronic throttle controller 100 (see FIG. 2).

In FIG. 1, reference numerals 13, 14, and 19 denote an exhaust passage, a combustion chamber, and a spark plug, respectively. Openings of the intake air passage 2 and the exhaust passage 13 to the combustion chamber 14, i.e., an intake air port 15 and an exhaust port 16, are provided with an intake air valve 17 and an exhaust valve 18, respectively. Further, a fuel injection valve (injector) 20 is provided so as to, in the present Embodiment 1, inject fuel to the intake air port 15 or directly to the combustion chamber 14.

By the way, as illustrated in FIG. 1, the engine ECU 10 performs drive control of the injector 20, drive control of an ignition coil (not shown) for actuating the spark plug 19, and open/close control of the electronically-controlled throttle valve 9 according to an acceleration command by the driver or according to the operating condition or abnormal condition of the engine.

Therefore, as illustrated in FIG. 1, the engine ECU 10 is adapted to accept input from the intake air amount sensor 3, the throttle position sensor (TPS) 104, the accelerator position sensor (APS) 105, a crank angle sensor (not shown) for detecting the rotational speed of the engine, a cylinder identification sensor (not shown) for identifying a first cylinder, an intake air temperature sensor (not shown), an atmospheric pressure sensor (notshown) for detecting the atmospheric pressure, an oxygen sensor (not shown) for detecting the concentration of oxygen in the exhaust gas, a vehicle speed sensor (not shown), an air conditioner switch (not shown), a shift position switch (not shown), a power steering switch (not shown) for detecting operating condition of the power steering, a starter switch (not shown), a water temperature sensor for detecting engine cooling water temperature, and the like.

The engine 1 is controlled by the engine ECU 10 to be described later based on the rotational speed of the engine and the above-described various kinds of input information (various parameters), and can calculate an optimum fuel injection amount and an optimum ignition timing (a point of time when ignition is carried out) according to the current operating condition of the engine.

Normally, the engine ECU 10 arbitrarily sets the target air-fuel ratio such that rich combustion or lean combustion is carried out based on the output of the oxygen sensor and the various parameters, and adjust the fuel injection amount accordingly. For example, at the time of acceleration, moving the vehicle, or the like, by changing the target air-fuel ratio such that sufficient output is obtained, rich combustion is carried out.

Further, the engine ECU 10 arbitrarily advances or retards the target ignition timing based on the rotational speed of the engine, the intake air amount, and the various parameters, so as to efficiently obtain engine output and produced torque while securing ignitability and combustion stability.

As described above, the engine ECU 10 performs various kinds of control according to the operating condition of the engine, and also, controls the throttle valve. Focusing attention on the throttle valve control, when the engine is under various kinds of loads in an idle state, since the throttle valve opening degree according to the accelerator opening degree can not supply a sufficient amount of air, a target throttle opening degree is set, which is greater than the throttle value opening degree according to the accelerator opening degree (idle speed control). Further, when the accelerator is depressed, a target throttle opening degree is set based not only on the amount of operation of the accelerator but also on various other parameters, and the throttle valve opening degree is controlled based on the target throttle opening degree.

Next, an intake air control system is described with reference to FIG. 2.

FIG. 2 is a view illustrating the configuration of an intake air control system of the electronic throttle controller.

In FIG. 2, the electronically-controlled throttle valve 9 being a constituent of the electronic throttle controller 100 is provided with a butterfly valve 101 disposed in the intake air passage in the throttle body 6, a butterfly valve support shaft 102 for supporting the butterfly valve 101, and an electromotor (throttle actuator) 103 for driving the butterfly valve support shaft 102 to rotate.

The butterfly valve support shaft 102 is provided with a first throttle position sensor 104A (TPSm) and a second throttle position sensor 104B (TPSs) as the throttle position sensor 104 for detecting the opening degree of the butterfly valve 101 (throttle opening degree). The two throttle position sensors (TPSm and TPSs) are provided in the controller to provide for abnormality in the throttle position sensors.

Therefore, as illustrated in FIG. 2, the engine ECU 10 is provided with a target throttle opening degree setting portion 106A and a throttle opening degree feedback control portion 106B.

Here, the electronic throttle control system is described with reference to FIG. 3.

Figure 3:
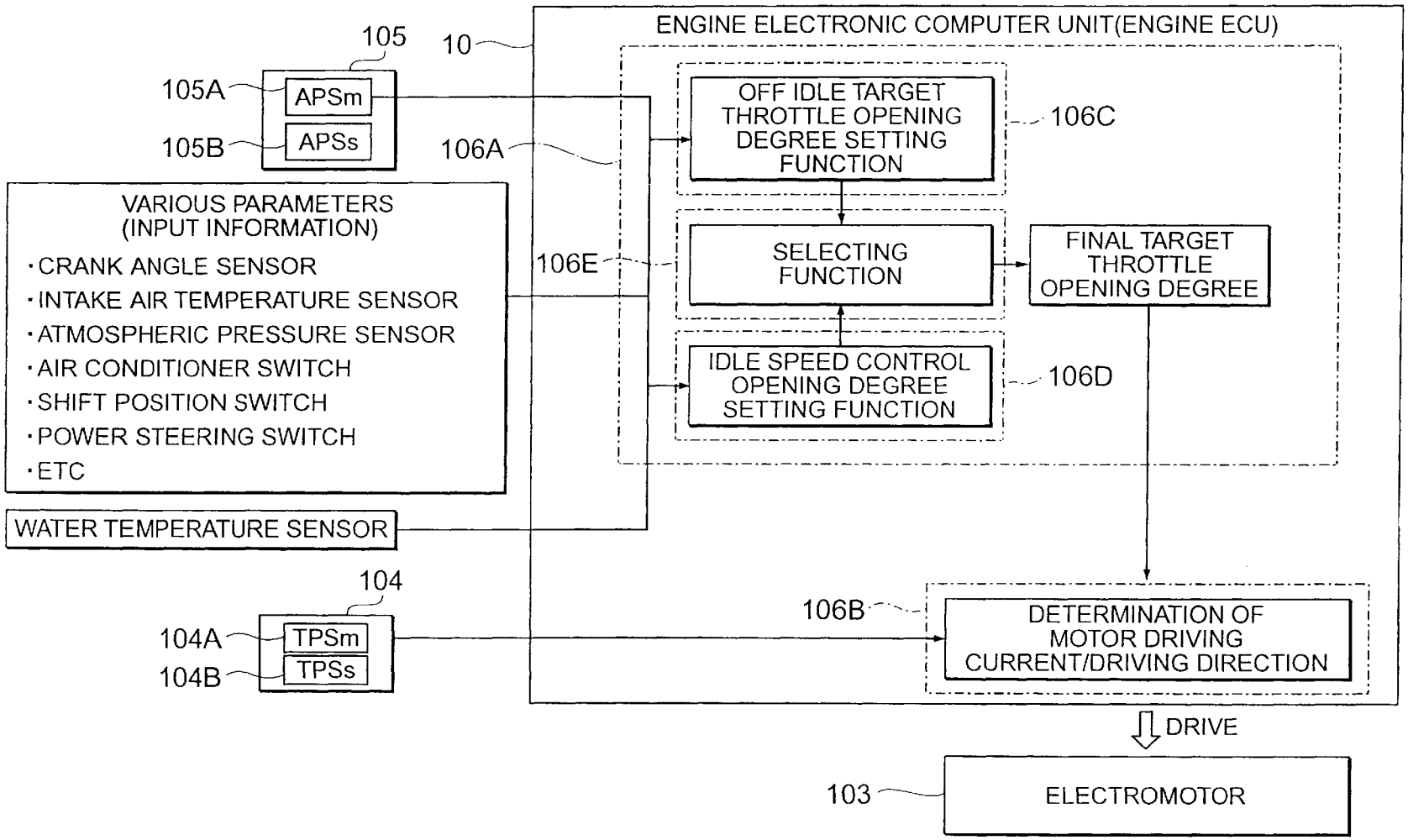
FIG. 3 is a block diagram illustrating the configuration of an electronic throttle control system according to Embodiment 1 of the present invention.

FIG. 3 is a block diagram illustrating the configuration of the electronic throttle control system.

As illustrated in FIG. 3, the target throttle opening degree setting portion 106A of the engine ECU 10 is provided with an off idle target throttle opening degree setting function 106C for setting the target throttle opening degree in the case of off idle based on information detected by a first accelerator position sensor (APSm) 105A and the above-described various parameters.

Further, the target throttle opening degree setting portion 106A is provided with an idle speed control opening degree setting function 106D for setting an idle speed control opening degree according to the various kinds of loads of the engine, cooling water temperature information of the engine detected by the water temperature sensor, and the like. The target throttle opening degree setting portion 106A is also provided with an off idle/on idle state selecting function 106E for selecting between an off idle state (condition where the accelerator is depressed) and an idle state. The selected set opening degree is a final target throttle opening degree of the throttle valve.

The throttle opening degree feedback control portion 106B determines motor driving current and a motor driving direction according to the final target throttle opening degree calculated by the target throttle opening degree setting portion 106A to control driving of the electromotor 103. Here, the throttle valve is under feedback control according to a throttle valve opening degree (actual throttle opening degree) detected by the first throttle position sensor (TPSm) 104A.

By the way, in the present controller, as illustrated in FIG. 2, similarly to the case of the throttle position sensors (TPSm and TPSs) 104A and 104B, two accelerator position sensors, i.e., the first accelerator position sensor (APSm) 105A and a second accelerator position sensor (APSs) 105B are provided as the accelerator position sensor 105. This also provides for abnormality.

A detection signal from the first accelerator position sensor (APSm) 105A enters the target throttle opening degree setting portion 106A to be used in setting the target throttle opening degree. When the first accelerator position sensor 105A is in failure, the second accelerator position sensor (APSs) 105B is used. The engine ECU 10 is also provided with an accelerator position sensor lower opening degree value selecting function (APSmin) 105C for comparing the detection signals from the first accelerator position sensor (APSm) 105A and from the second accelerator position sensor (APSs) 105B to detect the lower value thereof.

With regard to the throttle position sensor 104, a detection signal from the first throttle position sensor (TPSm) 104A enters the throttle opening degree feedback control portion 106B to be used in throttle opening degree feedback control. When the first throttle position sensor 104A is in failure, the second throttle position sensor (TPSs) 104B is used. The engine ECU 10 is also provided with a throttle position sensor lower opening degree value selecting function (TPSmin) 104C for comparing the detection signals from the first throttle position sensor (TPSm) 104A and from the second throttle position sensor (TPSs) 104B to detect the lower value thereof.

The engine ECU 10 is also provided with an abnormality deciding processing function 107 for deciding abnormality in the first and second accelerator position sensors 105A and 105B used in target throttle opening degree setting and in the first and second throttle position sensors 104A and 104B used in throttle opening degree feedback control. The abnormality includes (1) sensor open abnormality, (2) sensor power source short circuit abnormality, (3) sensor GND short circuit abnormality, (4) sensor GND open abnormality, (5) sensor power source open abnormality, and (6) sensor characteristic abnormality, and abnormality decision time 107A and abnormality decision counter 107B are provided respectively.

More specifically, with regard to the respective sensors, when requirements for deciding the above-described abnormality modes (1)–(6) are satisfied, and when such a state is maintained for the abnormality decision time 107A and for a range of the abnormality decision counter 107B which are set in advance, the engine ECU 10 determines that abnormality is caused with the abnormality deciding processing function 107.

Further, the engine ECU 10 is also provided with a fail-safe processing function 107C when a sensor is decided to be in failure, and, while the safety, the driving stability, and the emergent danger avoidability of the vehicle when a sensor is in failure are secured, the control is switched such that the driver recognizes the abnormality.

Still further, the engine ECU 10 is also provided with a warning light control function 109 for lighting or flashing a warning light 108 provided in an instrument panel of the vehicle, to inform the driver of the occurrence of abnormality and urge the driver to make an immediate repair.

As described above, the throttle opening degree of the electronic throttle controller 100 is, in a normal state, calculated by the off idle target throttle opening degree setting function 106C based on accelerator opening degree information from the first accelerator position sensor 105A, and, in an idle state, calculated by the idle speed control opening degree setting function 106D according to the various kinds of parameters of the engine, cooling water temperature information of the engine detected by the water temperature sensor, and the like, and the final target throttle opening degree is calculated by the target throttle opening degree setting portion 106A. Further, the throttle opening degree feedback control portion 106B determines a motor driving current and a motor driving direction according to the final target throttle opening degree calculated by the target throttle opening degree setting portion 106A, and the engine ECU 10 drives the actuator 103.

More specifically, in a region where the amount of operation of the accelerator is small and stable, from the viewpoint of the calculation by the target throttle opening degree setting portion 106A, it is normally unlikely that the butterfly valve 101 abruptly opens from the current opening degree, the intake air amount supplied to the engine is abruptly increased, and intake air amount signals per unit time detected by the intake air amount sensor 3 are abruptly increased. If such a state is caused, abnormality in the butterfly valve 101 being a constituent of the electronic throttle controller 100 or abnormality in the motor 103 for electrically driving the butterfly valve 101 is assumed to because. As other possibilities, there are abnormality in a signal detected by the first accelerator position sensor (APSm) 105A to be inputted to the target throttle opening degree setting portion 106A and abnormality in a signal detected by the first throttle position sensor (TPSm) 104A to be inputted to the throttle opening degree feedback control portion 106B. Causes of abnormal modes include abnormality in the accelerator position sensor 105 and the throttle position sensor 104 themselves, abnormality in a harness connecting the sensors to the computer, abnormality in a connector, abnormality in a sensor power source system, and a poor contact of a harness of the sensor power source system.

When abnormality is caused in the above-described constituents, depending on the abnormality mode, the rotational speed of the engine may unexpectedly increase, and, due to the unexpected event, the driver may make a mistake in driving.

Figure 4:
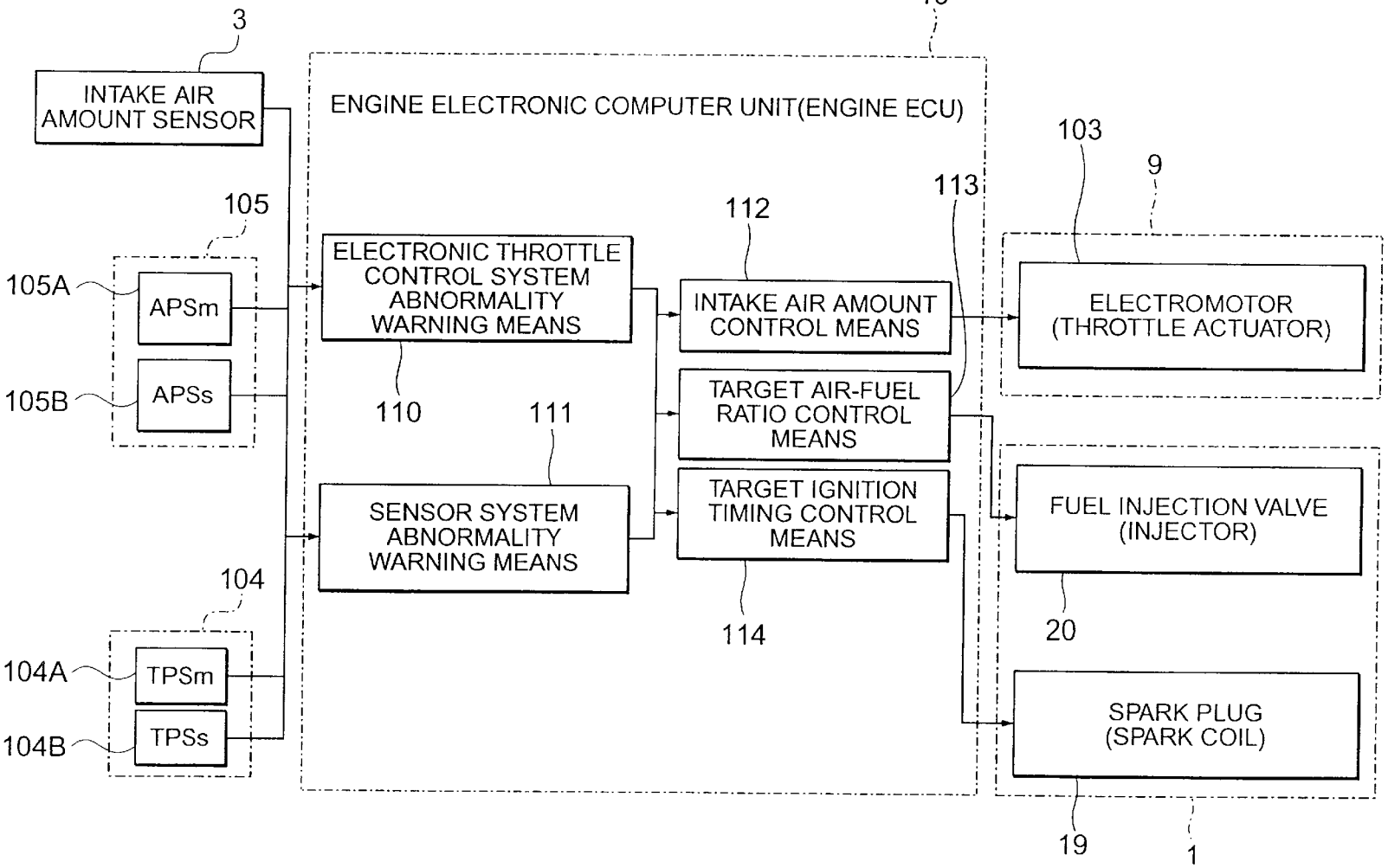
FIG. 4 is a block diagram focusing attention on main functions with regard to abnormality warning decision and abnormality warning processing of constituents of the electronic throttle control system according to Embodiment 1 of the present invention.

Next, focusing attention on features of the present invention, description is made with reference to FIGS. 2 and 4.

FIG. 4 is a block diagram focusing attention on main functions with regard to abnormality warning decision and abnormality warning processing of constituents of the electronic throttle control system according to Embodiment 1 of the present invention.

As illustrated in FIGS. 2 and 4, the engine ECU 10 is provided with an electronic throttle control system abnormality warning means 110 for deciding that increase in the rotational speed of the engine is assumed, and a sensor system abnormality warning means 111 for deciding abnormality warning of the throttle position sensor 104 and the accelerator position sensor 105 based on signals from them. Abnormality warning of the electronic throttle controller 100 described above is mainly decided by the electronic throttle control system abnormality warning means 110 and the sensor system abnormality warning means 111. The engine ECU 10 is also provided with an intake air amount control means 112,a target air-fuel ratio control means 113, and a target ignition timing control means 114.

Here, the electronic throttle control system abnormality warning means 110 is described.

The electronic throttle control system abnormality warning means 110 gives a warning of abnormality in a constituent of the electronic throttle controller 110 with the above-described warning light control function 109 for lighting or flashing the warning light 108. A first requirement for decision of electronic throttle control system abnormality warning is that all the following (1-1), (1-2), and (1-3) are satisfied:

(1-1) Not all the constituents of the electronic throttle controller 100 are decided to be normal;

(1-2) The intake air amount sensor 3 is normal; and (1-3) Both the accelerator position sensor lower opening degree selected value (APSmin)<a predetermined value V1 and the throttle position sensor lower opening degree selected value (TPSmin)<a predetermined value V2 are satisfied.

The decision of electronic throttle control system abnormality warning is made only when the above-described first requirement is satisfied. A second requirement for the decision of electronic throttle control system abnormality warning is that either one of the following (2-1) and (2-2) is satisfied:

(2-1) An intake air amount A1 per unit time T1>a predetermined value X1 is maintained for a predetermined number of sampling; or (2-2) The intake air amount An>a predetermined value Xn (in P/N ranges) is maintained for a predetermined number of sampling, or, an intake air amount Ad>a predetermined value Xd (in D/R ranges) is maintained for a predetermined number of sampling.

It is to be noted that the requirement (2-2) can be broken down into the case of the P/N ranges and the case of the D/R (reverse) ranges to be selected depending on a shift position detected by the shift position switch. The term "a predetermined number of sampling" means a sampling cycle of the intake air amount calculated by the engine ECU 10.

When the electronic throttle control system abnormality warning means 110 makes a decision of abnormality warning that the electronic throttle controller 100 is in failure and increase in the rotational speed of the engine is expected, the intake air amount control means 112 drives the electromotor 103 to control an opening degree upper limit of the target throttle opening degree setting portion 106A; the target air-fuel ratio control means 113 sets the target air-fuel ratio of the fuel injection valve 20 to be lean to suppress the fuel injection amount; and the target ignition timing control means 114 controls the ignition timing of the spark plug 19 to be substantially retarded. The processing is performed prior to the warning given by the warning light 108 of the abnormality in the electronic throttle controller 100. If the first requirement or the second requirement for the decision of electronic throttle control system abnormality warning is unsatisfied, the processing is canceled.

By the way, as described above, the engine ECU 10 is also provided with the sensor system abnormality warning means 111 for deciding abnormality warning of the sensors each being a constituent of the electronic throttle controller 100 when the sensors are in failure.

Here, the sensor system abnormality warning means 111 is described.

The sensor system abnormality warning means 111 warns abnormality in the sensors each being a constituent of the electronic throttle controller 100, i.e., the accelerator position sensor 105 (105A and 105B) and the throttle position sensor 104 (104A and 104B) as described above, and a third requirement for decision of the sensor system abnormality warning is that the following is satisfied:

(3-1) Not all the constituents of the electronic throttle controller 100 are decided to be normal.

The decision of sensor system abnormality warning is made only when the above-described third requirement is satisfied. A fourth requirement for the decision of sensor system abnormality warning is that either one of the following (4-1) and (4-2) is satisfied:

(4-1) The abnormality decision time 107A is being counted down or counted up; or (4-2) The abnormality decision counter 107B is being counted down or counted up.

When the sensor system abnormality warning means 111 makes a decision of abnormality warning that a sensor being a constituent of the electronic throttle controller 100 is in failure and increase in the rotational speed of the engine is expected, the intake air amount control means 112 drives the electromotor 103 to control the opening degree upper limit of the target throttle opening degree setting portion 106A, the target air-fuel ratio control means 113 sets the target air-fuel ratio of the fuel injection valve 20 to be lean to suppress the fuel injection amount, and the target ignition timing control means 114 controls the ignition timing of the spark plug 19 to be substantially retarded. When the abnormality deciding processing function 107 decides and determines sensor abnormality (when the abnormality decision time 107A or the abnormality decision counter 107B satisfies the requirement for abnormality decision for a predetermined time (for example, two seconds)), the fail-safe processing function 107C switches the control to the fail-safe control which is set in advance. Further, if the third requirement or the fourth requirement for the decision of sensor system abnormality warning is unsatisfied, the processing is canceled.

More specifically, when the electronic throttle control system abnormality warning means 110 or the sensor system abnormality warning means 111 decides abnormality warning that unexpected increase in the rotational speed of the engine is to be caused due to abnormality in the electronic throttle controller 100 or abnormality in a sensor being a constituent of the electronic throttle controller 100, the intake air amount control means 112 controls the opening degree upper limit of the target throttle opening degree setting portion 106A to prevent abnormal opening of the butterfly valve 101, and, even when the intake air amount is abruptly increased, the target air-fuel ratio control means 113 and the target ignition timing control means 114 set the target air-fuel ratio of the fuel injection amount to be lean and retard the ignition timing to control the combustion torque and engine produced torque to be suppressed, and thus, control is performed to prevent unexpected increase in the rotational speed of the engine.

Further, when, during the above-described control to prevent unexpected increase in the rotational speed of the engine is being performed, the abnormality deciding processing function 107 decides and determines sensor abnormality, the fail-safe processing function 107C switches the control to the fail-safe control which is set in advance such that, while the safety, the driving stability, and the emergent danger avoidability of the vehicle are secured, the driver recognizes the abnormality without fail.

Next, processing of electronic throttle control system abnormality warning and of sensor system abnormality warning of a fail-safe device for the electronic throttle control system according to Embodiment 1 of the present invention is described with reference to FIG. 5.

Figure 5:
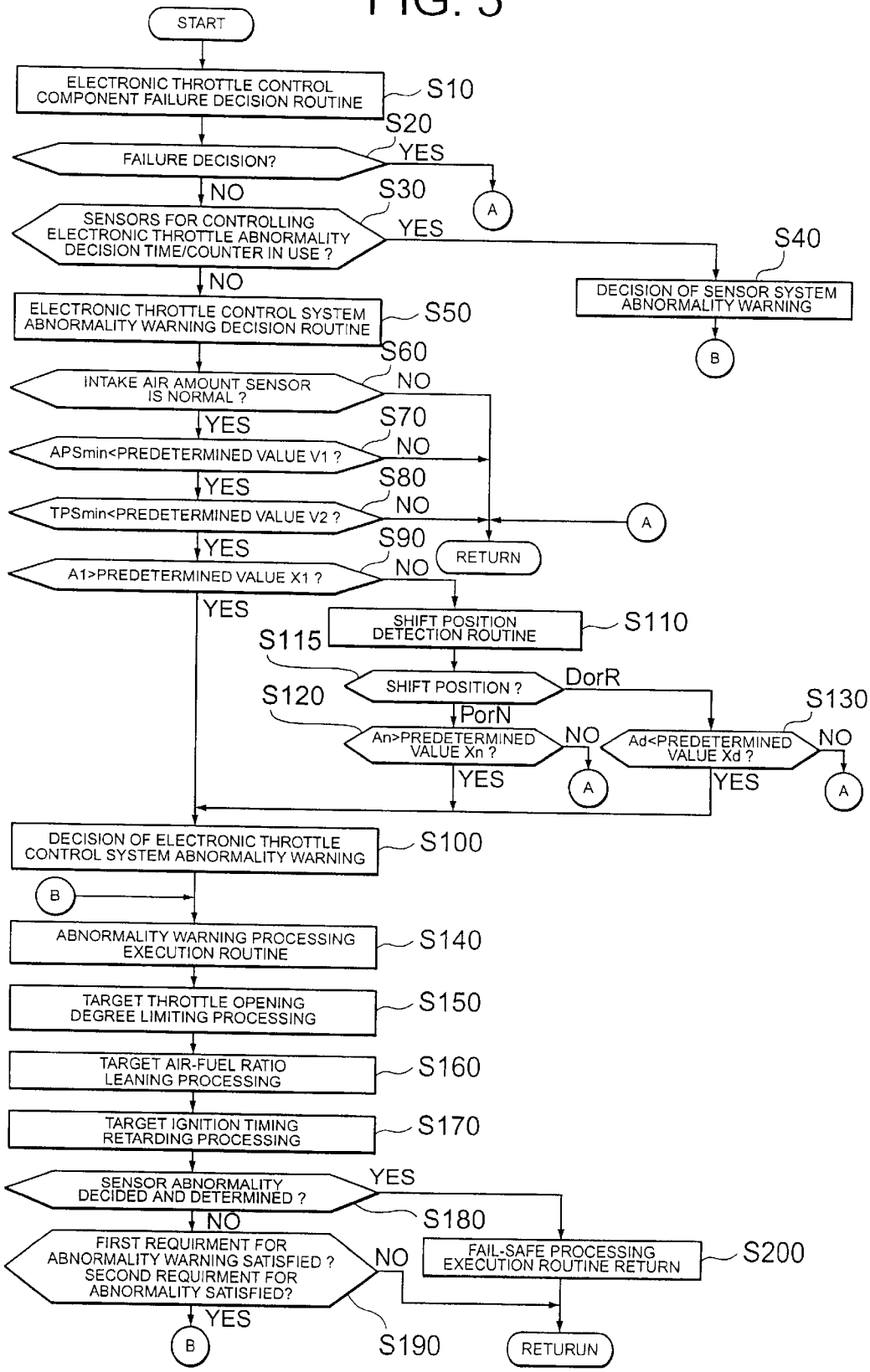
FIG. 5 is a flow chart illustrating processing of electronic throttle control system abnormality warning and of sensor system abnormality warning of a fail-safe device for the electronic throttle control system according to Embodiment 1 of the present invention.

FIG. 5 is a flow chart illustrating processing of electronic throttle control system abnormality warning and of sensor system abnormality warning of a fail-safe device for the electronic throttle control system according to Embodiment 1 of the present invention.

First, in step S10, the engine ECU 10 performs processing with regard to failure decision of the constituents of the electronic throttle controller 100 in a failure decision routine of the electronic throttle controller 100.

Then, in step S20, the failure decision of the constituents of the electronic throttle controller 100 goes through processing of whether a "presently out of order flag" is not set, whether an "out of order memory flag" was not set in the past, and whether a "warning light lighting when out of order flag" is not set, and the procedure proceeds to step S30.

Next, instep S30, decision is made as to whether the requirement for abnormality decision is satisfied or not with regard to the accelerator position sensor 105 (105A and 105B) and the throttle position sensor 104 (104A and 104B), and whether the abnormality decision time 107A or the abnormality decision counter 107B is operated or not. Here, if the abnormality decision time 107A or the abnormality decision counter 107B is operated, the procedure proceeds to step S40, where sensor system abnormality warning of the sensors each being a constituent of the electronic throttle controller is decided, and then, the procedure proceeds to an abnormality warning processing execution routine in step S140.

On the other hand, if the abnormality decision time 107A and the abnormality decision counter 107B are not operated, the procedure proceeds to an electronic throttle control system abnormality warning decision routine in step S50.

Then, in steps S60 to S80, decision is made as to whether the intake air amount sensor 3 is normal or not, whether the accelerator position sensor lower opening degree selected value (APSmin) is smaller than the predetermined value V1 or not, and whether the throttle position sensor lower opening degree selected value (TPSmin) is smaller than the predetermined value V2 or not. When all the requirements (1-1), (1-2), and (1-3) are satisfied, the procedure proceeds to step S90. Here, if any of the requirements are not satisfied in steps S60, S70, and S80, the procedure exits the electronic throttle control system abnormality warning decision routine.

Next, in step S90, decision is made as to whether an intake air amount A1 exceeds the predetermined value X1 or not, i.e., whether the intake air amount per unit time is increased or not. Here, if the intake air amount A1 exceeds the predetermined value X1, the procedure proceeds to electronic throttle control system abnormality warning decision in step S100.

On the other hand, if, in step S110, the intake air amount A1 does not exceed the predetermined value X1, the procedure proceeds to a shift position detection routine in step S110.

Then, in step S115, a shift position is decided. If the shift position is in the P range or in the N range, the procedure proceeds to step S120, and whereas if the shift position is in the D range or in the R range, the procedure proceeds to step S130.

Next, in step S120, decision is made as to whether the intake air amount An exceeds the predetermined value Xn or not. If the intake air amount An exceeds the predetermined value Xn, the procedure proceeds to the electronic throttle control system abnormality warning decision in step S100, and whereas if not, it is assumed that no abnormality is caused in the electronic throttle control system, and the procedure exits the flow chart.

Next, in step S130, decision is made as to whether the intake air amount Ad exceeds the predetermined value Xd or not. If the intake air amount Ad exceeds the predetermined value Xd, the procedure proceeds to the electronic throttle control system abnormality warning decision in step S100, and whereas if not, it is assumed that no abnormality is caused in the electronic throttle control system, and the procedure exits the flow chart.

Then, in step S140, if the sensor system abnormality warning in step S40 is decided, or, if the electronic throttle control system abnormality warning of step S100 is decided, the procedure proceeds to the abnormality warning processing execution routine.

Next, in steps S150 to S170, by executing, as the abnormality warning processing execution routine, target throttle opening degree limiting processing, target air-fuel ratio leaning processing, and target ignition timing retarding processing, the combustion torque and engine produced torque are controlled to be suppressed.

Then, in step S180, while the abnormality warning deciding processing is being executed, it is detected whether decision is made that the accelerator position sensor 105 or the throttle position sensor 104 is in failure, and whether the abnormality is determined (the requirement for the abnormality decision is maintained for a predetermined time (for example, two seconds)). If the abnormality is not decided or not determined, the procedure proceeds to step S190. On the other hand, if the abnormality is decided and determined, the procedure proceeds to the fail-safe processing execution routine in step S200.

Next, in step S190, while the abnormality warning deciding processing is being executed, it is detected whether the above-described first requirement (steps S20, S60, S70, and S80) and second requirement (steps S90, S115, S120, and S130), or, the above-described third requirement (step S20) and fourth requirement (step S30) are satisfied or not. If the answer is YES, the procedure goes back to the abnormality warning processing execution routine in step S140. If the answer is NO, it is assumed that no abnormality is caused in the electronic throttle control system and the sensor system, or that the systems recovered from abnormality, and the procedure exits the flow chart.

Then, in step S200, processing is performed in which, while securing the safety, the driving stability, and the emergent danger avoidability of the vehicle, the driver is made to recognize the abnormality without fail.

More specifically, while the abnormality warning deciding processing is being executed, if the accelerator position sensor 105 or the throttle position sensor 104 is decided and determined to be in failure, even if the abnormality warning deciding processing is being executed, the engine ECU 10 switches the control to the fail-safe processing. Further, while the abnormality warning deciding processing is being executed, if the requirements for the decision of abnormality warning are not satisfied, the procedure exits the abnormality warning processing execution routine.

It is to be noted that, though, in Embodiment 1, a case is described where the engine controller configured such that the engine electronic computer unit 10 also controls the throttle opening degree is applied, the engine controller of the present invention is not limited thereto. The present invention can be widely applied to vehicles provided with an electronic throttle controller and configured such that the throttle is controlled by a computer unit other than the engine electronic computer unit.

What is claimed is:

1. A fail-safe device for an electronic throttle control system comprising:

an intake air amount sensor for detecting an intake air amount to an engine;

a throttle position sensor for detecting a throttle opening degree of an electronic throttle controller, said electronic throttle controller controlling a throttle valve based on an amount of pressing down on an accelerator;

an accelerator position sensor for detecting an accelerator opening degree as an amount of pressing down on said accelerator;

an intake air amount control means for controlling the intake air amount to said engine;

a target air-fuel ratio control means for controlling a fuel injection amount to be supplied to said engine;

a target ignition timing control means for controlling ignition timing of air-fuel mixture inside a cylinder of said engine; and an electronic throttle control system abnormality warning means for deciding, when a first requirement and a second requirement are satisfied based on the output of said intake air amount sensor, said throttle position sensor, and said accelerator position sensor, that said electronic throttle controller is in failure, and prior to warning of the abnormality of said electronic throttle controller, controlling said intake air amount control means, said target air-fuel ratio control means, and said target ignition timing control means.

2. A fail-safe device for an electronic throttle control system according to claim 1, further comprising:

a fail-safe processing function for, when a sensor is decided to be in failure, performing control such that the driver recognizes the abnormality while securing safety, driving stability, and emergent danger avoidability of the vehicle;

an abnormality deciding processing function for, when the abnormality of the sensor is decided and determined based on the output of said throttle position sensor and said accelerator position sensor, switching the control to fail-safe control by said fail-safe processing function; and a sensor system abnormality warning means for, when a third requirement and a fourth requirement are satisfied, controlling said intake air amount control means, said target air-fuel ratio control means, and said target ignition timing control means before the abnormality of said sensor is determined.

3. A fail-safe device for an electronic throttle control system according to claim 1, wherein when said first requirement and said second requirement are satisfied, said electronic throttle control system abnormality warning means said sensor system abnormality warning means limits the intake air amount to be supplied to said engine with said intake air amount control means.

4. A fail-safe device for an electronic throttle control system according to claim 1, wherein when said first requirement and said second requirement are satisfied, said electronic throttle control system abnormality warning means sets the fuel injection amount to be supplied to said engine to be lean with said target air-fuel ratio control means to suppress combustion torque.

5. A fail-safe device for an electronic throttle control system according to claim 1, wherein when said first requirement and said second requirement are satisfied, said electronic throttle control system abnormality warning means sets ignition timing of the air-fuel mixture inside said cylinder of said engine to be retarded with said target ignition timing control means to suppress engine produced torque.

6. A fail-safe device for an electronic throttle control system according to claim 2, wherein when said third requirement and said fourth requirement are satisfied, said sensor system abnormality warning means limits the intake air amount to be supplied to said engine with said intake air amount control means.

7. A fail-safe device for an electronic throttle control system according to claim 2, wherein when said third requirement and said fourth requirement are satisfied, said sensor system abnormality warning means sets the fuel injection amount to be supplied to said engine to be lean with said target air-fuel ratio control means to suppress combustion torque.

8. A fail-safe device for an electronic throttle control system according to claim 2, wherein when said third requirement and said fourth requirement are satisfied, said sensor system abnormality warning means sets ignition timing of the air-fuel mixture inside said cylinder of said engine to be retarded with said target ignition timing control means to suppress engine produced torque.

* * * * *